US007540323B2

(12) United States Patent
McAnally

(10) Patent No.: US 7,540,323 B2
(45) Date of Patent: Jun. 2, 2009

(54) WELL PUMPING SYSTEM WITH PUMP ROD TRASH CUPS

(76) Inventor: Charles W. McAnally, Box 2106, Fort Davis, TX (US) 79734

( * ) Notice: Subject to any disclaimer, the term of this patent is extended or adjusted under 35 U.S.C. 154(b) by 789 days.

(21) Appl. No.: 10/916,924

(22) Filed: Aug. 12, 2004

(65) Prior Publication Data

US 2006/0034718 A1 Feb. 16, 2006

(51) Int. Cl.
*E21B 43/34* (2006.01)
*E21B 43/00* (2006.01)

(52) U.S. Cl. ..... 166/105.4; 166/105.1; 166/105.2; 166/107; 417/555.1; 417/548

(58) Field of Classification Search ..... 166/105.2, 166/105.4, 105.1, 105.3, 107; 417/548, 555.1
See application file for complete search history.

(56) References Cited

U.S. PATENT DOCUMENTS 1,672,687 A * 6/1928 Penrod et al. ..... 166/105.4
2,664,828 A * 1/1954 Le Bus ..... 166/105.2
2,669,940 A * 2/1954 Crake ..... 166/105.2
2,863,704 A * 12/1958 Hillman ..... 166/241.4
3,090,324 A * 5/1963 Schmidt ..... 166/105.2
5,873,157 A * 2/1999 Hart et al. ..... 29/402.08
6,135,203 A * 10/2000 McAnally ..... 166/105.2

* cited by examiner

*Primary Examiner*—Devon C Kramer
*Assistant Examiner*—Leonard J Weinstein
(74) *Attorney, Agent, or Firm*—Gardere Wynne Sewell LLP

(57) ABSTRACT

A rod actuated downhole well pumping system is provided with spaced apart annular elastomer members secured to the pump rod at predetermined intervals to prevent solids particulates entrained in the pumped fluid from settling down to and clogging the pump mechanism during periods of pumping activity. The elastomer members are provided with longitudinal slits so that they may be sleeved over a pump rod without disconnecting the rod from the pump assembly in retrofitted installations. The elastomer members are preferably secured to the pump rod with a suitable adhesive and are of a diameter at least slightly less than the inner diameter of the tubing through which fluid is being pumped.

12 Claims, 3 Drawing Sheets

WELL PUMPING SYSTEM WITH PUMP ROD TRASH CUPS

BACKGROUND OF THE INVENTION

In certain applications of downhole well pumps, solids particulates become entrained in the pumped fluid and, during periods of pump shutdown, such particulates tend to settle out of the fluid and collect at the pump including the pump discharge ports, resulting in clogging of the pump, or damage to the pump, or both.

Certain applications of rod actuated downhole well pumps require relatively intermittent pump operation and also comprise applications where particulate fines are ever present in the pumped fluid. For example, gas wells in certain types of earth formations, such as coal beds, typically require intermittent pumping to remove liquid, primarily water, from the wellbore to avoid interfering with gas flow. Since operation of the pump is often quite intermittent and long periods of inactivity occur, the long column of liquid in the well tubing string will result in substantial settling of abrasive solids particulates at the bottom of the tubing string whereupon the pump mechanism may be clogged or damaged by the collection of such material. The present invention overcomes this problem, as will be appreciated by those skilled in the art of rod actuated well pumps.

SUMMARY OF THE INVENTION

The present invention provides an improved well pumping system including a rod actuated pump assembly comprising an elongated pump rod with spaced apart members operable to facilitate removal of solid particulates from the well fluid flow path and to minimize collection of such particulates at the pump mechanism during periods of pump inactivity.

In accordance with an important aspect of the present invention, a rod actuated downhole well pumping system is provided with plural, generally cylindrical, spaced apart so-called trash removing members disposed in the fluid conducting tubing string and connected to the pump actuating rod, which members have a diameter less than the inner diameter of the tubing in which the members and the pump rod are disposed. However, the members are of sufficient diameter as to minimize the settling of solids particulates entrained in the pumped fluid during operation of the pump and during periods of pump inactivity. The so-called trash removing members may each have a somewhat conical or cup-shaped recess formed in the upward facing end thereof, respectively, to collect solids particulates which settle out of the pumped fluid, primarily during periods of pump inactivity and when gravitational forces acting on the particulates would otherwise result in the particulates falling to the bottom of the well and clogging the pump mechanism.

In accordance with another aspect of the invention, trash removing members are provided for a well pumping system including a rod actuated pump wherein the members are formed of a suitable elastomer and may be assembled to a cylindrical pump rod without requiring that the members be sleeved over the pump rod from one end thereof. In particular, the members are provided with a longitudinal slit which allows them to be resiliently deflected and placed in sleeved relationship around the pump rod and then secured to the rod by a suitable adhesive which may also be used for adhering the member to itself at the aforementioned slit. In this way, existing pumping systems may be retrofitted in applications where entrained particulates are tending to interfere with pumping operations.

Those skilled in the art will further appreciate the above-mentioned advantages and superior features of the invention, together with other important aspects thereof, upon reading the detailed description which follows in conjunction with the drawing.

DETAILED DESCRIPTION OF A PREFERRED EMBODIMENT

Figure 1:
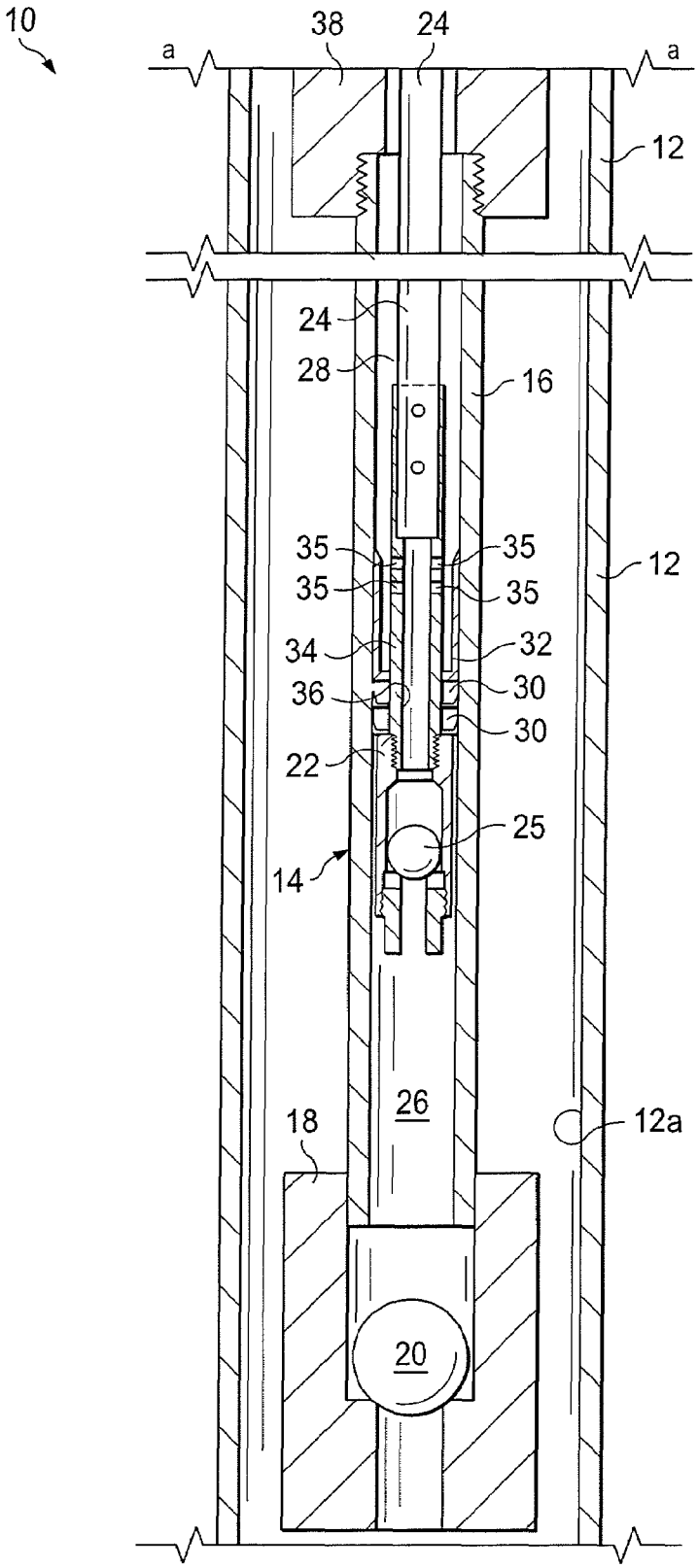
FIG. 1 is a longitudinal central section view of a portion of a well pumping system including a rod actuated pump utilizing the present invention.

In the description which follows like parts are marked throughout the specification and drawing with the same reference numerals, respectively. The drawing figures may not be to scale and certain features may be shown in generalized or schematic form in the interest of clarity and conciseness.

The well pumping system in accordance with the present invention is related in certain respects to the well pumping systems disclosed and claimed in U.S. Pat. No. 5,699,858 issued Dec. 23, 1997 and U.S. Pat. No. 6,135,203 issued Oct. 24, 2000, both to Charles W. McAnally. The subject matter of U.S. Pat. Nos. 5,699,858 and 6,135,203 is incorporated herein by reference. Although the pumping systems disclosed in U.S. Pat. Nos. 5,699,858 and 6,135,203 particularly enjoy the benefits of the present invention, the invention may be utilized with conventional downhole rod actuated well pumps also. Moreover, many applications of such conventional pumps and tubing sizes used therewith may benefit from the invention.

Figure 2:
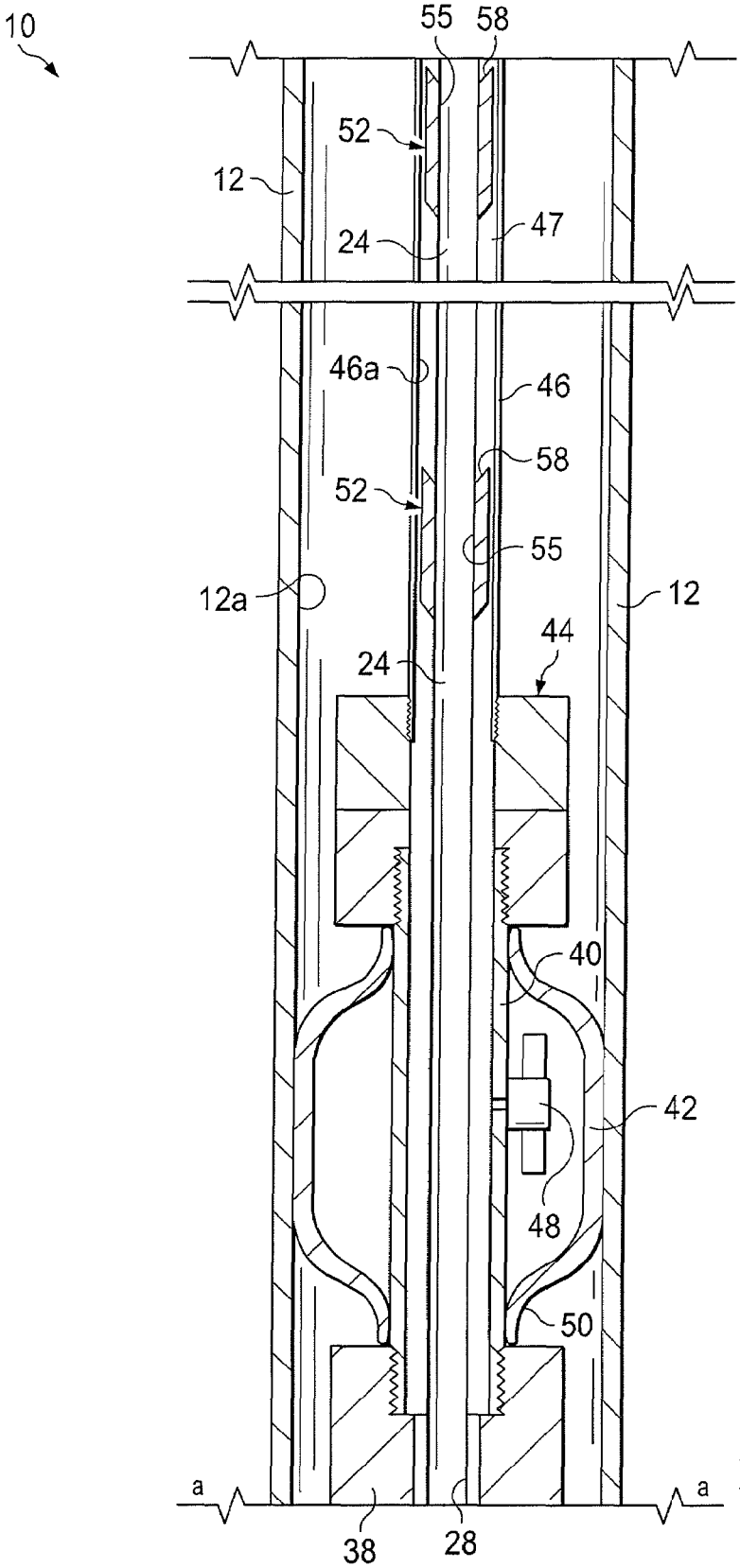
FIG. 2 is a continuation of FIG. 1 from the line a-a indicated in both FIGS. 1 and 2.

Referring to FIGS. 1 and 2, a well pumping system in accordance with the invention is illustrated and generally designated by the numeral 10. The well pumping system 10 is shown disposed in a generally elongated cylindrical well casing 12 which may be disposed in a wellbore for various purposes. As mentioned above, one particular advantageous application of the pumping system 10 is for gas wells which are also producing subterranean liquids, such as water, having solids particulates, such as coal dust fines, entrained therein. Pumps operated in such wells may only require operation very intermittently to remove water from the wellbores so as not to inhibit the production of gas. Accordingly, a rod actuated pump 14 is provided, FIG. 1, which may be substantially like the pump disclosed in U.S. Pat. No. 6,135,203.

The pump 14 includes an elongated cylindrical barrel 16, the lower end of which is connected to a valve housing 18, having a spherical closure member 20 disposed therein and comprising the so-called standing valve. A pump plunger 22 is disposed in the pump barrel 16 and is connected to an elongated actuating rod 24. The opposite end of rod 24 may be connected to suitable pump actuating mechanism on the surface, such as the mechanism disclosed in U.S. Pat. Nos. 5,699,858 and 6,135,203. In response to reciprocation of the plunger 22, a traveling valve comprising a closure member 25 is operable to transfer fluid from a chamber 26 to an annular passage 28 in a known manner. Plunger 22 is provided with dual, adjacent, annular seals 30 retained on plunger 22 by a particulate material or trash collection cup member 32 which is sleeved over and secured to a reduced diameter extension part 34 of plunger 22. Plunger extension part 34 is provided with suitable ports 35 and an elongated passage 36 therein for transferring fluid from chamber 26 to passage 28 again, in a manner similar to the arrangement provided for the pump disclosed in U.S. Pat. No. 6,135,203.

The upper end of barrel 16 is connected to a coupler 38, which, in turn, is connected to a tubing section 40, FIG. 2, forming part of a fluid actuated pump anchor assembly 42 substantially like the pump anchor assembly disclosed in U.S. Pat. No. 5,699,858. Tube section 40 is connected to a coupler assembly 44 which, in turn, is also connected to an elongated fluid conducting tube 46 extending upward through the casing 12, as shown in FIG. 2, for conducting liquid pumped by the pump 14 to the Earth's surface, not shown, or to other liquid handling means, also not shown. The anchor assembly 42 may include a suitable pressure regulating valve 48, FIG. 2, for limiting the pressure of fluid from within tubing string 46 acting on the flexible and distendable bladder member 50 of the anchor assembly to limit forcible engagement of the bladder with the inner wall 12*a* of casing 12, as illustrated in FIG. 2.

Figure 3:
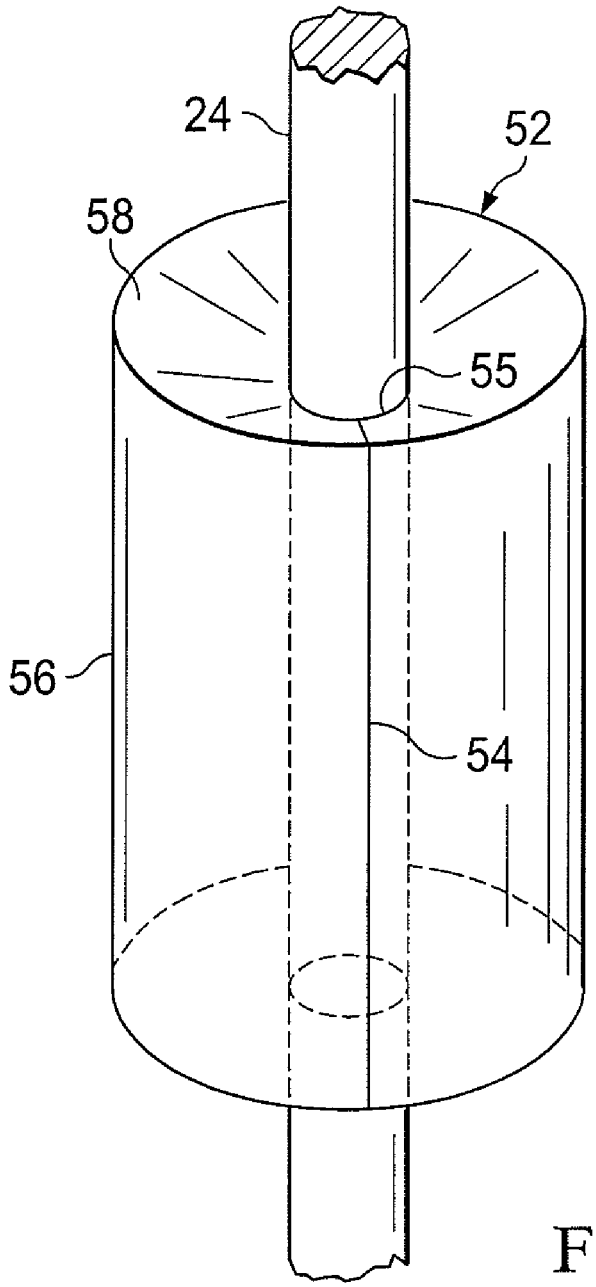
FIG. 3 is a detail perspective view showing one of the particulate entrapping or trash cup members for the rod actuated pump system shown in FIGS. 1 and 2.

Referring further to FIG. 2, the pump actuating rod 24, which may be formed of suitable materials including solid fiberglass, is provided with spaced apart generally annular trash cup members 52 which have an outside diameter slightly less than the diameter of inner wall 46*a* of the tubing 46 so as to provide an annular fluid flowpath between the inner wall 46*a* of tubing 46 and the outer circumferential surfaces of the members 52. The members 52 are preferably formed of a suitable elastomer, such as natural or synthetic rubber, having a durometer or hardness in a range of about 60 to 80 Shore A, for example. Other materials having high abrasion and chemical resistance characteristics may be used and should also be flexible enough such that each of the members 52 may be slit longitudinally at a slit 54, see FIG. 3, and so that it may be spread sufficiently to be sleeved over the rod 24. In this regard also, the members 52 are provided with a central bore 55, FIG. 2, to permit sleeving the members over the rod 24. Accordingly, the slit 54 extends from an outer circumferential surface 56, FIG. 3, of each of the members 52 to the bore 55. The upper end of each of the members 52 may also be configured to provide a somewhat conical shaped recess 58, FIG. 3, for collection of solids particulates which may tend to descend through the annular fluid flow passage 47 formed by the tubing 46. Accordingly, during periods of inactivity of the pump system 10, liquid standing in the annular passage 47 will tend to allow particulate solids entrained therein to settle out and these solids will collect in the recesses 58 of the spaced apart members 52. Moreover, during operation of the pumping system 10, the so-called trash cups or members 52 will assist in moving the solids particulates entrained in the liquid being pumped upwardly through the passage 47 with the liquid so that these particulates are removed from the pumping system.

Accordingly, the trash cups or members 52 may be installed in a rod actuated pump assembly without disconnecting the rod sections from each other, since the members 52 do not require to be sleeved over the ends of the rod 24 but may be installed in predetermined positions along the rod, such as at forty foot to fifty foot intervals, for example, by spreading each member at the slit 54 sufficient to move the member over the rod 24. With a suitable adhesive disposed in the bore 55 and on the surfaces of the member delimited by the slit 54 each member 52 may be fixed to the rod 24 at predetermined intervals. The procedure described above is also particularly advantageous for a rod actuated pump having a continuous rod 24 between the pump 14 and surface disposed pump actuating mechanism. The difference in diameter between the members 52 and the bore or inner wall 46*a* of the tubing 46 may be only that necessary to minimize restriction of fluid flow in the annular passage formed between the members and the tubing 46. For a pump rod of about 0.50 inches diameter and a nominal diameter of the members 52 of about 1.0 inches, an annular clearance of about 0.13 inches minimum is desirable and may be maintained over a fairly wide range of tubing diameters. Accordingly, the diameter of tubing wall 46*a* should be about 1.25 inches, for example. The members 52 preferably have an overall length about 1.5 to 2.0 times the outer diameters of the members which is believed to assist in generating sufficient turbulence and fluid velocity during reciprocation of rod 24 to aid in maintaining particulates suitably entrained in the upward moving fluid.

Thanks to the provision of the trash cups or members 52 spaced along the pump rod 24, particulates entrained in liquid being pumped to the surface by the pumping system 10 are prevented from collecting at the pump 14, particularly within the passage 28 of the barrel 16, although some particulates are trapped and retained in the cup member 32 also.

Conventional engineering materials and practices may be used to carry out the invention disclosed herein except as otherwise described herein. Although a preferred embodiment of the invention has been described in detail, those skilled in the art will also recognize that various substitutions and modifications may be made without departing from the scope and spirit of the appended claims.

What is claimed is:

1. In a rod actuated well pump system, a pump including a cylinder forming a fluid flow passage, a plunger disposed in said cylinder for reciprocation therein, said plunger being connected to an elongated actuating rod, said actuating rod extending within an elongated tubing string for conducting fluid from said pump to the Earth's surface, the improvement characterized by:

plural spaced apart annular members sleeved over and secured to said actuating rod at spaced apart points therealong, said members are formed of an elastomeric material, said members having a diameter less than an inside wall diameter of said tubing string to allow fluid flow through said tubing string from said pump, said members being operable to urge particulate solids entrained in fluid being pumped through said tubing string to flow upward toward the Earth's surface and to minimize settling of said solids at said pump when said pump is not in operation, said members are formed with an elongated slit extending from an outer surface to a bore defining the annular shape of said members whereby said members may be mounted on said actuating rod by deflecting said members at said slit sufficiently to slip said members over said actuating rod and become engaged therewith.

2. The invention set forth in claim 1 wherein: said members are secured to said actuating rod by an adhesive.

3. The invention set forth in claim 1 wherein:

said members are formed of natural or synthetic rubber, having a durometer or hardness in a range of about 60 to 80 Shore A.

4. The invention set forth in claim 1 wherein:

said members are secured to said rod and to close said slit by an adhesive.

5. The invention set forth in claim 1 wherein:

said members are formed with a recess facing upward in said tubing string for collecting particulates settling out of a liquid column in said tubing string.

6. The invention set forth in claim 1 wherein;

said members are spaced apart in a range of about 40 feet to 50 feet on said actuating rod.

7. The invention set forth in claim 1 wherein:

said pump includes an upward facing trash collection cup member mounted on said plunger for collecting particulates entrained in a liquid column in said tubing string to minimize clogging said pump with said particulates.

8. The invention set forth in claim 1 including:

a pressure fluid anchor secured to said tubing string for anchoring said tubing string and said pump in a well casing using pressure fluid from said tubing string, said pressure fluid anchor including a pressure regulating valve for regulating the pressure of fluid acting on said anchor.

9. In a rod actuated well pump system, a pump including a cylinder forming a fluid flow passage, a plunger disposed in said cylinder for reciprocation therein, said plunger being connected to an elongated actuating rod, said actuating rod extending within an elongated tubing string for conducting fluid from said pump to the Earth's surface, the improvement characterized by:

plural spaced apart annular members formed of an elastomer material and sleeved over and secured to said actuating rod at spaced apart points therealong, said members having a diameter less than an inside wall diameter of said tubing string to allow fluid flow through said tubing string from said pump, said members being operable to urge particulate solids entrained in fluid being pumped through said tubing string to flow upward toward the Earth's surface and to minimize settling of said solids at said pump when said pump is not in operation, and said members are formed with an elongated slit extending from an outer surface to a bore defining the annular shape of said members whereby said members may be mounted on said actuating rod by deflecting said members at said slit sufficiently to slip said members over said actuating rod and become engaged therewith, and said members are secured to said actuating rod by an adhesive.

10. The invention set forth in claim 9 wherein:

said members are formed with a recess facing upward in said tubing string for collecting particulates settling out of a liquid column in said tubing string.

11. The invention set forth in claim 9 wherein:

said members are spaced apart in a range of about 40 feet to 50 feet on said actuating rod.

12. In a rod actuated well pump system, a pump including a cylinder forming a fluid flow passage, a plunger disposed in said cylinder for reciprocation therein, said plunger being connected to an elongated actuating rod, said actuating rod extending within an elongated tubing string for conducting fluid from said pump to the Earth's surface, the improvement characterized by:

plural spaced apart annular members formed of an elastomer and secured to said actuating rod by an adhesive at spaced apart intervals of about 40 feet to 50 feet, said members having a diameter at least about 0.25 inches less than an inside wall diameter of said tubing string to allow fluid flow through said tubing string from said pump, said members being operable to urge particulate solids entrained in fluid being pumped through said tubing string to flow upward toward the Earth's surface and to minimize settling of said solids at said pump when said pump is not in operation, said members are formed with an elongated slit extending from an outer surface to a bore defining the annular shape of said members whereby said members may be mounted on said actuating rod by deflecting said members at said slit sufficiently to slip said members over said actuating rod and become engaged therewith, and said members are each formed with an upward facing recess for collecting particulates settling out of a liquid column in said tubing string.

* * * * *